US012509874B2

(12) United States Patent
Tanner

(10) Patent No.: US 12,509,874 B2
(45) Date of Patent: Dec. 30, 2025

(54) CONTAINER STACKING FOR HOUSING

(71) Applicant: Stack Racks, LLC, Westminster, CO (US)

(72) Inventor: Brian Tanner, Westminster, CO (US)

( * ) Notice: Subject to any disclaimer, the term of this patent is extended or adjusted under 35 U.S.C. 154(b) by 0 days.

(21) Appl. No.: 19/218,802

(22) Filed: May 27, 2025

(65) Prior Publication Data

US 2025/0361713 A1 Nov. 27, 2025

Related U.S. Application Data

(60) Provisional application No. 63/651,625, filed on May 24, 2024.

(51) Int. Cl.
*E04B 1/343* (2006.01)

(52) U.S. Cl.
CPC ..... *E04B 1/34384* (2013.01); *E04B 1/34331* (2013.01)

(58) Field of Classification Search
CPC ..... E04B 1/34384; E04B 1/34331
See application file for complete search history.

(56) References Cited

U.S. PATENT DOCUMENTS 3,752,511 A * 8/1973 Racy ..... B65D 90/0013 410/82
5,072,845 A * 12/1991 Grogan ..... B65D 90/0013 206/821
5,237,784 A * 8/1993 Ros ..... E04B 1/34352 52/79.5
5,847,537 A * 12/1998 Parmley, Sr. ..... B60L 8/003 52/79.9
6,027,291 A 2/2000 Sain et al.
6,422,795 B2 * 7/2002 Holt ..... B60P 7/0815 410/82
6,658,799 B1 * 12/2003 Stoodley ..... E04B 1/34823 52/79.11
6,877,939 B2 * 4/2005 Tomkins ..... B65D 90/0013 410/82
8,186,110 B2 5/2012 Green
8,347,560 B2 * 1/2013 Gyory ..... E04B 1/34363 52/79.5
8,826,601 B2 9/2014 Gyory et al.
9,121,168 B2 9/2015 Levy et al.
9,598,854 B2 * 3/2017 Ter-Borch ..... E06B 1/342
10,208,475 B2 * 2/2019 Heather ..... B65D 90/0026
10,337,184 B2 * 7/2019 Coupe ..... E04B 1/34315
10,480,176 B2 * 11/2019 Unger ..... E04B 1/34384
10,689,840 B2 * 6/2020 Bonlin ..... E04G 21/14
10,947,718 B2 3/2021 Unger
10,975,562 B2 * 4/2021 Griechen ..... E04B 1/2403
11,174,630 B2 * 11/2021 Bowron ..... E04B 1/2604
11,248,372 B2 * 2/2022 Griechen ..... E04B 1/1903
(Continued)

*Primary Examiner* — Rodney Mintz
(74) *Attorney, Agent, or Firm* — MP Patents, LLC

(57) ABSTRACT

A modular housing system includes a number of side beams, a number of transverse beams each spanning two or more of the side beams, at least one spine beam spanning two or more of the spanning beams, a number of isosceles angle irons provided to exterior surfaces of the side beams, a number of scalene angle irons provided to exterior surfaces of the side beams opening away from the isosceles angle irons and a number of corner support braces each coupled to one of the side beams abutting one of the isosceles angle irons.

21 Claims, 10 Drawing Sheets

(56) References Cited

U.S. PATENT DOCUMENTS

2002/0009346 A1* 1/2002 Holt ..... B65D 90/0053 410/94
2003/0188507 A1 10/2003 Cote, Jr.
2004/0028495 A1* 2/2004 Tomkins ..... B65D 88/121 410/46
2007/0271857 A1 11/2007 Heather et al.
2010/0018131 A1* 1/2010 Green ..... E04B 1/24 52/79.5
2010/0269419 A1* 10/2010 Gyory ..... E04B 1/34384 52/79.5
2011/0162293 A1* 7/2011 Levy ..... E04B 1/3483 52/79.9
2012/0006369 A1* 1/2012 Cantin ..... E04B 1/34384 135/96
2012/0151851 A1* 6/2012 Cantin ..... E04B 1/34336 52/79.5
2012/0266546 A1* 10/2012 Gyory ..... E04B 1/3444 52/126.1
2014/0298745 A1 10/2014 Rechenmacher et al.
2015/0152634 A1* 6/2015 Unger ..... E04B 1/34336 52/79.8
2015/0247316 A1* 9/2015 Coupe ..... E04B 1/34384 52/655.1
2015/0267396 A1* 9/2015 Cantin ..... E04H 1/1205 52/79.5
2016/0153185 A1* 6/2016 Ter-Borch ..... E06B 1/6015 52/698
2016/0160515 A1 6/2016 Wallance
2018/0135295 A1 5/2018 Bowron
2019/0153720 A1* 5/2019 Bonlin ..... E04B 1/34317
2020/0149266 A1* 5/2020 Griechen ..... E04B 2/58
2020/0190789 A1* 6/2020 Unger ..... E04H 1/005
2021/0189713 A1* 6/2021 Griechen ..... E04B 1/08
2024/0011277 A1* 1/2024 Côté ..... E04B 1/2403
2024/0426096 A1* 12/2024 Ramsay ..... E04B 1/3483
2025/0215685 A1* 7/2025 Côté ..... E04B 1/08

* cited by examiner

CONTAINER STACKING FOR HOUSING

CROSS-REFERENCE TO RELATED APPLICATIONS

This application claims the priority benefit of U.S. Provisional Application No. 63/651,625 filed May 24, 2024, which is incorporated herein by reference in its entirety.

SUMMARY

The disclosure describes a corner support brace. The corner support brace includes a top plate, a bottom plate, a first back plate, a second back plate, a first face plate and a second face plate and a mid-plate. The top plate includes first, second, third and fourth edges and a hole of a first variety within the edges. The bottom plate includes first, second, third and fourth edges and a hole of the first variety within the edges. The first back plate includes a first end coupled to the first edge of the top plate and a second end coupled to the first edge of the bottom plate. The second back plate includes a first end coupled to the second edge of the top plate and a second end coupled to the second edge of the bottom plate. The first face plate includes at least one hole of a second variety, a first end coupled to the third edge of the top plate and a second end coupled to the third edge of the bottom plate. The second face plate includes at least one hole of the second variety, a first end coupled to the fourth edge of top plate and a second end coupled to the fourth edge of the bottom plate. The mid-plate is coupled between the first and second back plates and the first and second face plates and spaced apart from the top and bottom plates.

The disclosure also describes a stacking frame. The stacking frame includes an first upper side beam extending along a length between a front end and a rear end, a first lower side beam extending along a length between a front end and a rear end, a second upper side beam extending along a length between a front end and a rear end, a second lower side beam extending along a length between a front end and a rear end, a first transverse beam spanning the first upper and second upper side beams at the front end and a second transverse beam spanning the first upper and second upper side beams at the rear end, a third transverse beam spanning the first lower and second lower side beams at the front end, a fourth transverse beam spanning the first lower and second lower side beams at the rear end, a fifth transverse beam spanning the first upper and second side beams between the front and rear ends, a sixth transverse beam spanning the first upper and second side beams between the fifth transverse beam and the rear ends, a first spine beam spanning the first transverse beam and the fifth transverse beam, a second spine beam spanning the fifth transverse beam and the sixth transverse beam, a first isosceles angle iron provided to an exterior surface of the first upper side beam opening towards the rear end of the first upper side beam, a second isosceles angle iron provided to an exterior surface of the first lower side beam opening towards the rear end of the first lower side beam, a third isosceles angle iron provided to an exterior surface of the second upper side beam opening towards the rear end of the second upper side beam, a fourth isosceles angle iron provided to an exterior surface of the second lower side beam opening towards the rear end of the second lower side beam, a fifth isosceles angle iron provided to an exterior surface of the first upper side beam opening towards the front end of the first upper side beam, a sixth isosceles angle iron provided to an exterior surface of the first lower side beam opening towards the front end of the first lower side beam, a seventh isosceles angle iron provided to an exterior surface of the second upper side beam opening towards the front end of the second upper side beam, an eighth isosceles angle iron provided to an exterior surface of the second lower side beam opening towards the front end of the second lower side beam, a first scalene angle iron provided to an exterior surface of the first upper side beam opening towards the front end of the first upper side beam, a second scalene angle iron provided to an exterior surface of the first lower side beam opening towards the front end of the first lower side beam, a third scalene angle iron provided to an exterior surface of the second upper side beam opening towards the front end of the second upper side beam, a fourth scalene angle iron provided to an exterior surface of the second lower side beam opening towards the front end of the second lower side beam and a butt joint angle iron configured to extend from an exterior surface of one or more of the side beams.

Further, the disclosure describes a modular housing system. The modular housing system includes a number of side beams, a number of transverse beams spanning two or more of the side beams, at least one spine beam spanning two or more of the transverse beams, a number of isosceles angle irons provided to exterior surfaces of the side beams, a number of scalene angle irons provided to exterior surfaces of the side beams opening away from the isosceles angle irons and a number of corner support braces each coupled to one of the side beams abutting one of the isosceles angle irons.

BRIEF DESCRIPTION OF THE FIGURES

The summary above, as well as the following detailed description of illustrative embodiments, is better understood when read in conjunction with the appended drawings. For the purpose of illustrating the present disclosure, example constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

DETAILED DESCRIPTION

Figure 1:
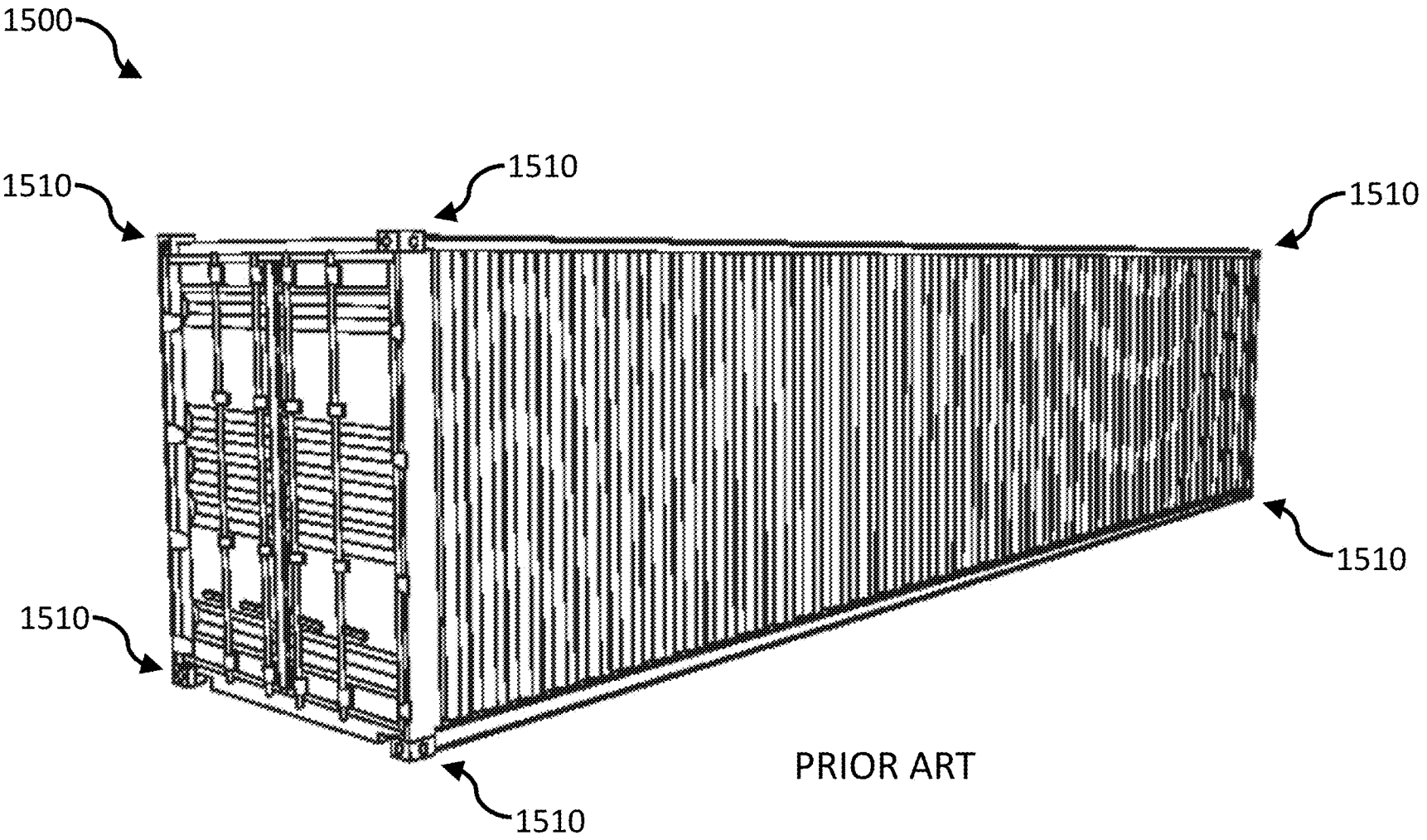
PRIOR ART FIG. 1
FIG. 1 illustrates an example shipping container suitable for use in association with disclosed stacking frames, corner support braces, stacking frame systems and modular housing systems.
Figure 2:
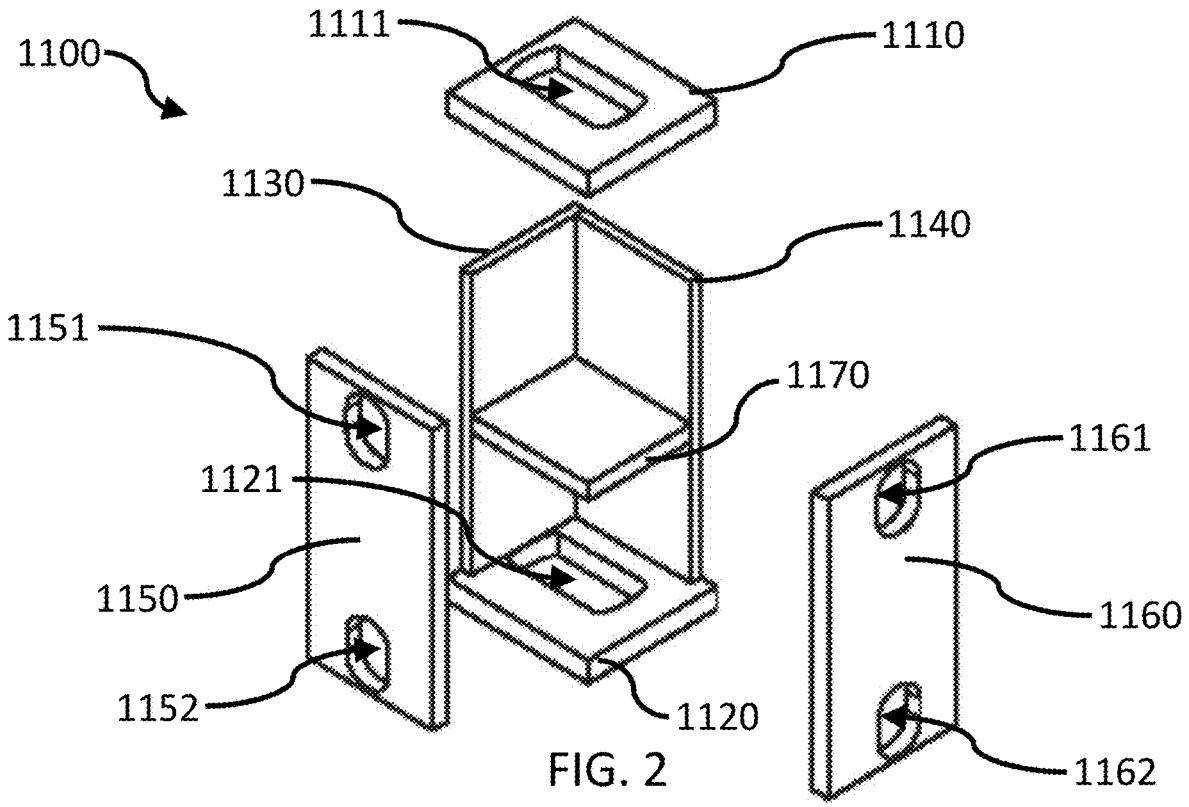
FIG. 2 illustrates an exploded view of an example corner support brace suitable for use in association with disclosed framing systems and modular housing systems.
Figure 3:
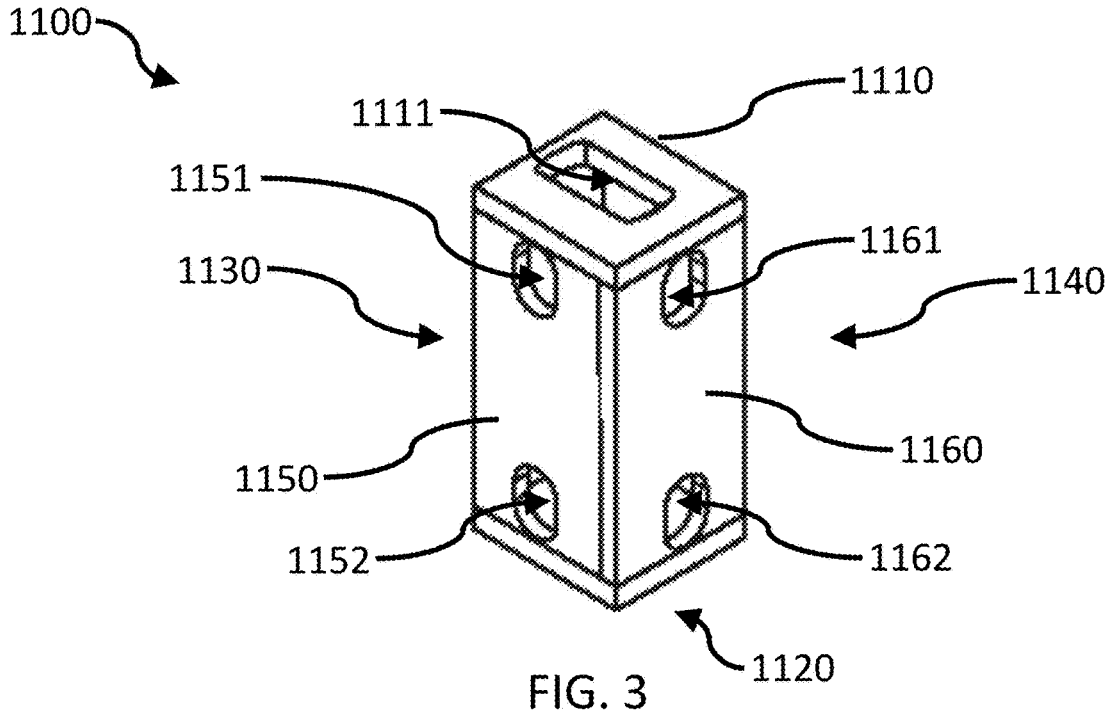
FIG. 3 illustrates a perspective view of the example corner support brace of FIG. 2.
Figure 4:
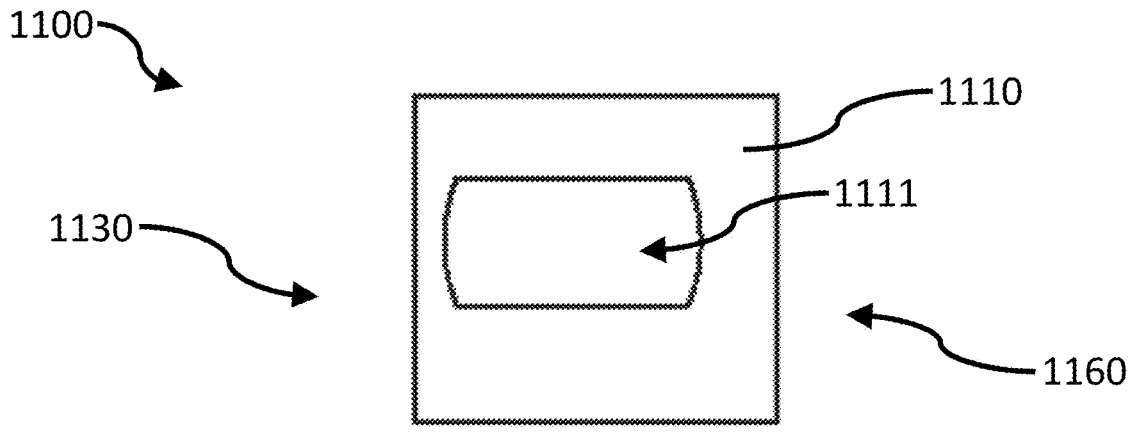
FIG. 4 illustrates a top view of the example corner support brace of FIGS. 2 & 3.
Figure 5:
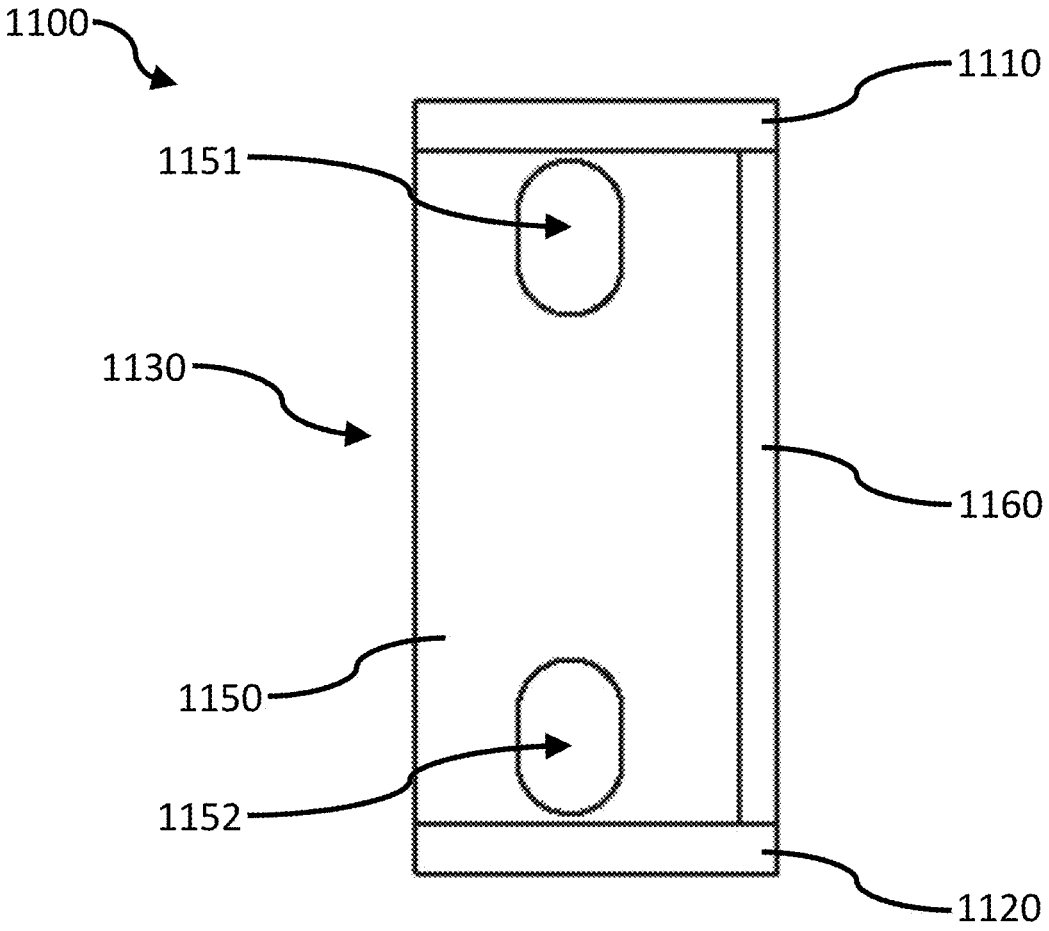
FIG. 5 illustrates a front view of the example corner support brace of FIGS. 2-4.
Figure 7:
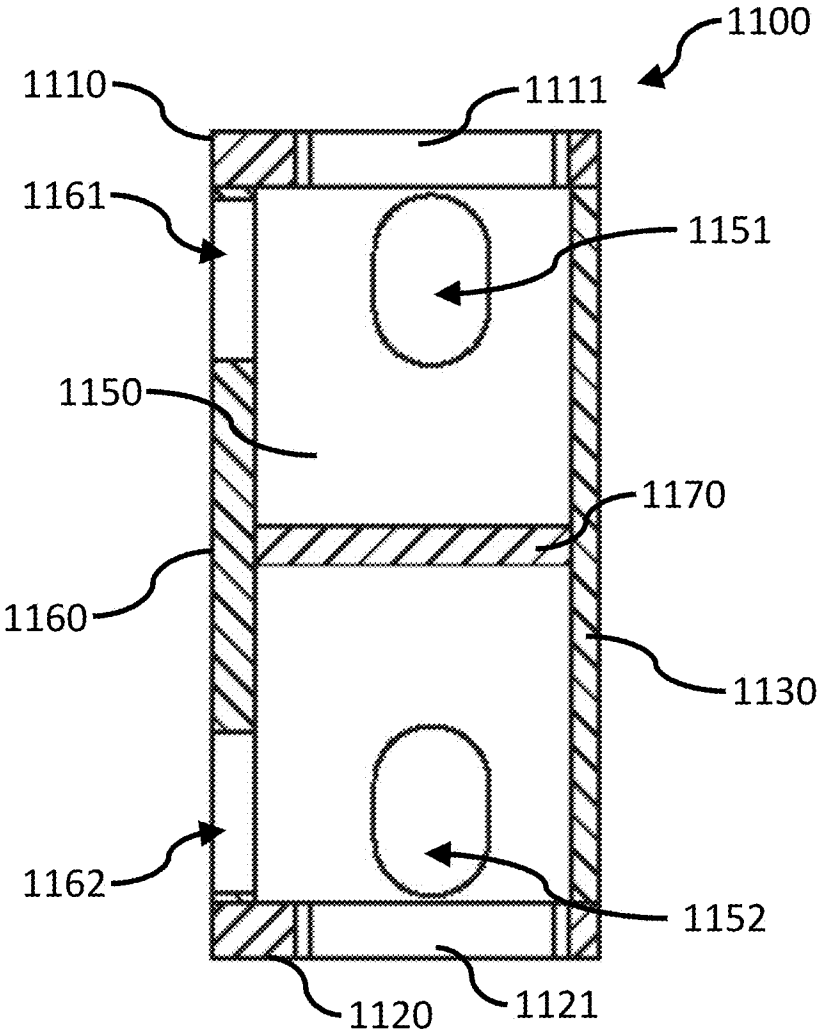
FIG. 7 illustrates a rear sectional view of the example corner support brace of FIGS. 2-6
Figure 6:
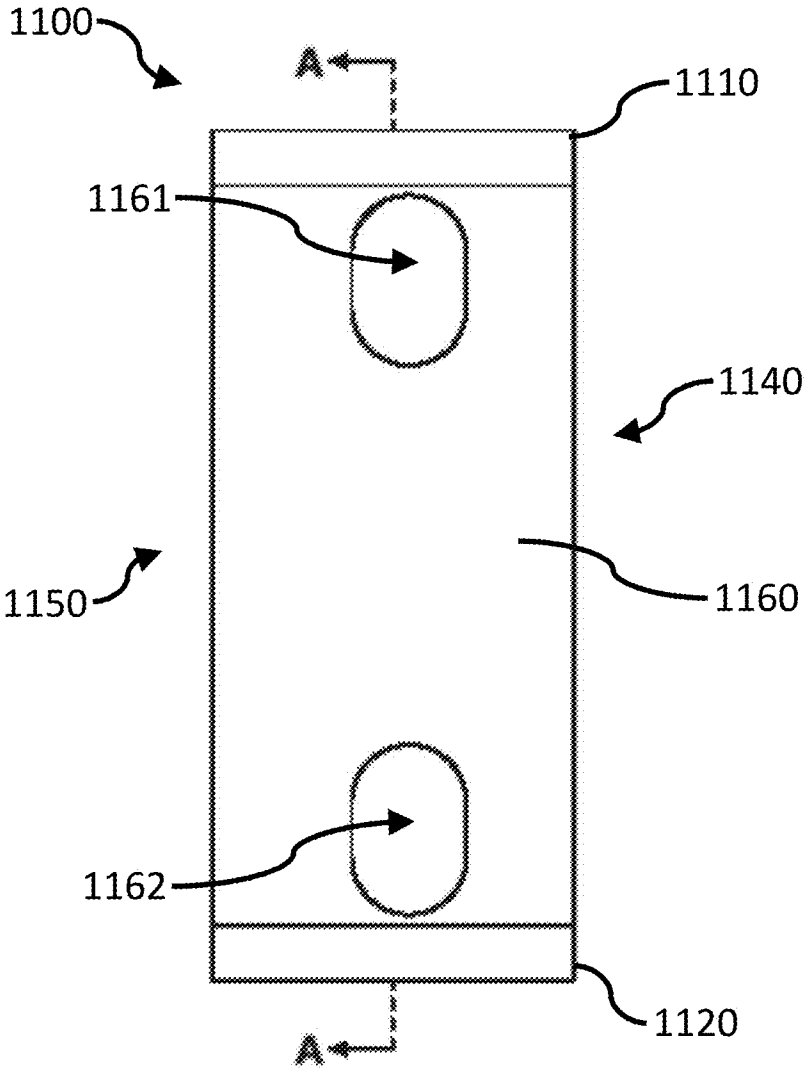
FIG. 6 illustrates a right side view of the example corner support brace of FIGS. 2-5.
Figure 8:
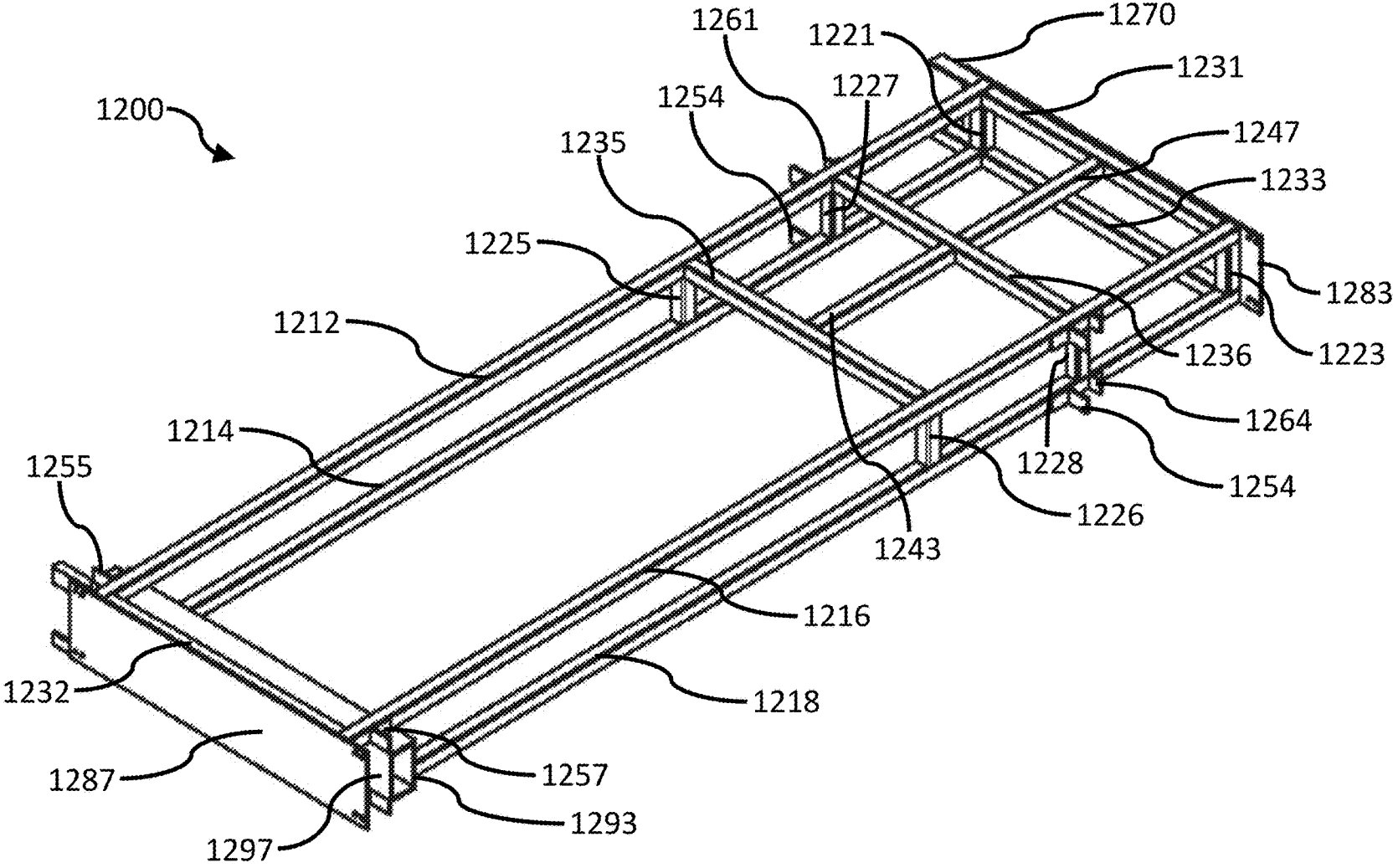
FIG. 8 illustrates a perspective view of an example stacking frame.
Figure 9:
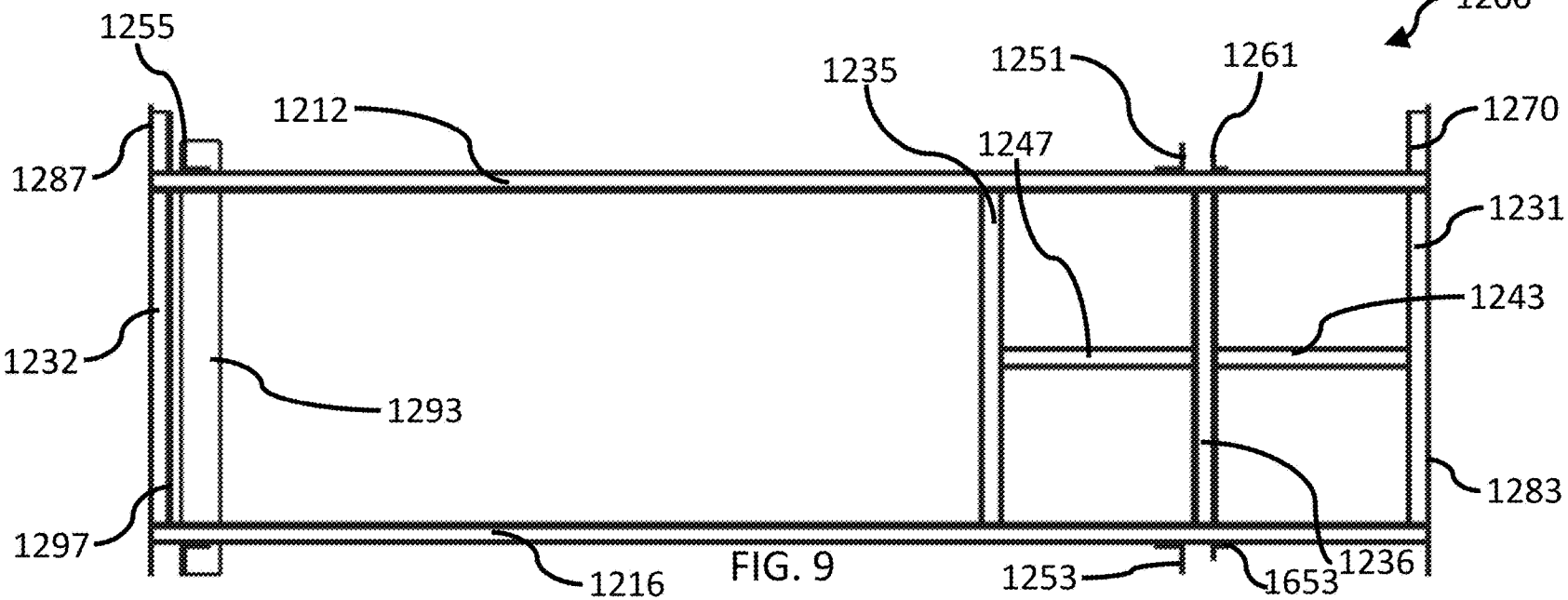
FIG. 9 illustrates a top view of the example stacking frame of FIG. 8.
Figure 10:
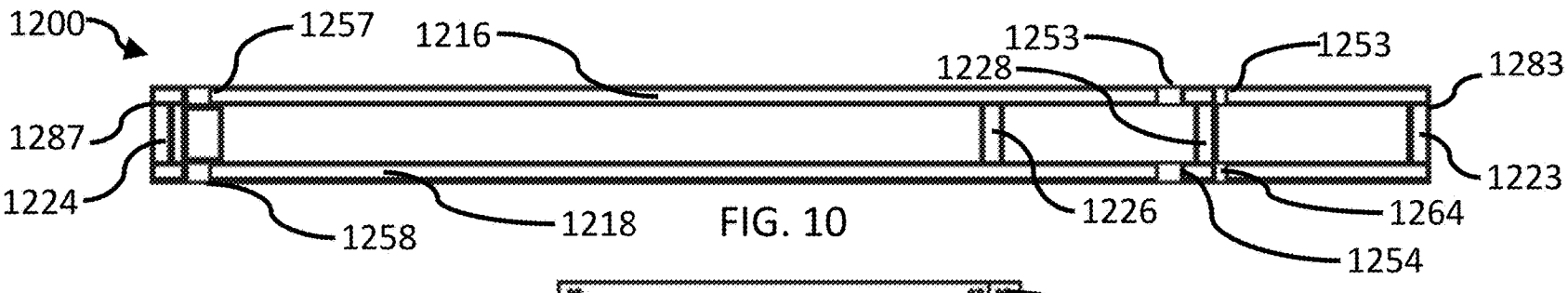
FIG. 10 illustrates a side view of the example stacking frame of FIGS. 7 & 8.
Figure 11:
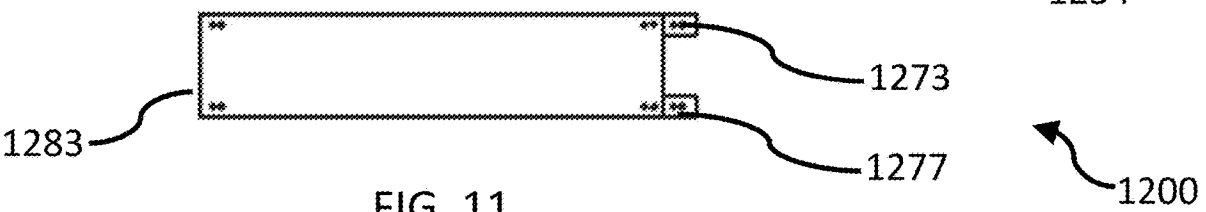
FIG. 11 illustrates a front view of the example stacking frame of FIGS. 7-9.

The following detailed description illustrates embodiments of the present disclosure and manners by which they can be implemented. Although the best mode of carrying out the present disclosure has been disclosed, those skilled in the art would recognize that other embodiments for carrying out or practicing the present disclosure are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Shipping containers have more recently become recognized and used as readymade, highly sturdy boxes or frames that can be singularly converted or combined in various configurations to provide a living space. However, multiple living spaces cannot be arranged so as to be stacked into a structure more than one shipping container high.

While shipping containers can support massive amounts of heavy loads and can be stacked atop one another up to ten stories high, as typically seen on large ocean-going cargo ships and in major portal harbors and trainyards throughout the world, this current stacking operation requires one container to be laid directly upon the container below it and is secured to the lower container that it rests upon with a three-inch-high steel protrusion inserted into and aligning with the shipping container directly above it. This is a worldwide and universal system requiring a standard sized container box constructed in a manner that places the load bearing capacity of the container box on the four corner posts of the container and provides the means to securely stack ten fully loaded cargo containers atop one another.

While this stacking procedure works well for cargo bearing containers, this methodology limits and/or prohibits reasonable access by which to enter or exit, much less live in the containers once they have been stacked "metal to metal" atop one another in this manner. These universal constraints of all international cargo shipping containers being laid directly against and in direct contact with those directly above and/or below it eliminates the option of converting multiple layers of shipping containers into living spaces being more than one container high.

The existing stacking process used in the freight shipping industry eliminates all space between the shipping containers or any means to provide utility sewer and waste lines, hot and cold running water, habitable HVAC devices, sleeping and cooking areas, bathrooms etc. that are minimal habitation requirements. Disclosed systems provide the means to readily build a well-insulated fully functioning multi-story building of apartments.

Disclosed embodiments eliminate all the limiting restrictions and constraints cited above and provide the means to build multi-story buildings using, for example, a manufactured structure which creates separation, spacing and support between each level of the stacked containers installed during the building (i.e., "stacking") process. The system gives horizontal structural support for multiple apartments aligned side by side and enables vertical stacking of multiple layers or floors of apartments. The system provides means to distribute all household utility services including electricity, water, sewer, and HVAC to each apartment and each level of the structure has its own set of balconies/walkways and stairways built into the structure to provide convenient ingress/egress to the apartments.

Additional aspects, advantages, features and objects of the disclosure will be made apparent from the drawings and the detailed description of the illustrative embodiments construed in conjunction with the appended claims that follow.

It will be appreciated that described features are susceptible to being combined in various combinations without departing from the scope of the disclosure as defined by the appended claims.

With disclosed framing systems and butt joint components, multiple apartment complexes to be joined with other buildings in any combination of side by side, back-to-back, end to end, front to front, etc. to create various configurations of building to accommodate open spaces, parking areas, differing terrain or simply for convenience or aesthetic purposes.

FIG. 1 illustrates an example shipping/storage container 1500 suitable for use in association with disclosed stacking frames, corner support braces, stacking frame systems and modular housing systems. Container 1500 includes a corner casting 1500 at each of the corner enabling container 1500 to be coupled together with other containers through the corner castings 1510 by way of a twist lock or Tantlinger lock which couples between aligned holes of the corner castings 1510. Corner castings have a hollow interior and six sides with three being penetrated by holes of different types.

Common hole types include stadium or discorectangle holes, shield holes and stacking holes. Stadium holes are commonly found on lower corner castings directed away from the front and/or rear face of the shipping container and/or on the upper corner castings directed away from the left and/or right sides of the shipping container. Shield holes are commonly found on upper corner castings directed away from the front and/or rear face of the shipping container and/or on the lower corner castings directed away from the left and/or right sides of the shipping container. Stacking holes are commonly found on upper corner castings directed away from the top face of the shipping container and/or on the lower corner castings directed away from the bottom face of the shipping container.

FIGS. 2-7 illustrate an example corner support brace 1100 suitable for use in association with disclosed and prior art shipping containers as well as in association with disclosed framing systems and modular housing systems. Disclosed corner support braces 1100 enable spacing vertically stacked shipping containers to accommodate necessary residential or commercial infrastructure such as plumbing, heating, ventilation, air conditioning, networking conduits or a crawl-space or an insulation space.

Corner support brace 1100 includes a top plate 1110, a bottom plate 1120, a first back plate 1130, a second back plate 1140, a first face plate 1150 and a second face plate 1160 and a mid-plate 1170. Top plate 1110 includes first, second, third and fourth edges and a hole 1111 of a first variety within the edges. Bottom plate 1120 includes first, second, third and fourth edges and a hole 1121 of the first variety within the edges. First back plate 1130 includes a first end coupled to the first edge of the top plate and a second end coupled to the first edge of the bottom plate. Second back plate 1140 includes a first end coupled to the second edge of the top plate and a second end coupled to the second edge of the bottom plate.

First face plate 1150 includes at least one hole 1151 of a second variety, a first end coupled to the third edge of the top plate and a second end coupled to the third edge of the bottom plate. Second face plate 1160 includes at least one hole 1161 of the second variety, a first end coupled to the fourth edge of top plate and a second end coupled to the fourth edge of the bottom plate. Face plate 1160 may include a second hole 1162 of the second variety. First face plate 1150 may include a second hole 1152 of the second variety or may include one or more holes of a third variety Second face plate 1160 may include a second hole 1162 of the second variety one or may include or more holes of a third variety. All holes are configured for locking together with a twist lock which is sometimes referred to as a Tantlinger lock (not shown). Mid-plate 1170 is coupled between the first and second back plates and the first and second face plates and spaced apart from the top and bottom plates.

Plates 1110, 1120, 1130, 1140, 1150, 1160 and 1170 may be formed from any of a variety of solid, durable structural materials suitable for supporting multiple living units including but not limited to steel. Plates 1110, 1120, 1130, 1140, 1150, 1160 and 1170 may be provided in any of a variety of dimensions suitable for forming a corner casting brace suitable for spacing apart first and second corner castings such as those commonly provided to the corners of shipping containers. A number of corner support braces 1100 may be used to space a pair of shipping containers with or without disclosed stacking frames.

In an example, a distance between the first and second ends of the first and second back plates 1130, 1140 and first and second face plates 1150, 1160 may be approximately equal. In an example, each of the first and second face plates 1150, 1160 and first and second back plates 1130, 1140 has a length at least twice its width.

In a further example, the length of first and second face plates 1150, 1160 and first and second back plates 1130, 1140 is about 13" and the thickness of the first and second face plates and the first and second back plates is about 0.5" while the first face plate has a width of about 6.375", the second face plate has a width of about 6.25", the first back plate has a width of about 5.75" and the second back plate has a width of about 5.625".

In an example, a distance defined between the first and second ends of the first and second back plates 1130, 1140 and first and second face plates 1150, 1160 may be approximately twice a distance defined between first and third edges of bottom plate 1120 or a distance defined between second and fourth edge of the bottom plate. In an example, bottom plate 1120 may have a length approximately equal to a width of second back plate 1140 plus a thickness of the first back plate 1130 plus a thickness of the second front plate 1160. In an example, bottom plate 1120 may have a width approximately equal to a width of the first back plate plus a thickness of the first front plate.

In a further example, top plate 1110 has a length of about 7", a width of about 6.375" and a thickness of about 1" while bottom plate 1120 has a length of about 7", a width of about 6.375" and a thickness of about 1". Mid-plate 1170 may have a length of about 5.75", a width of about 5.125" and a thickness of about 0.75".

Holes 1111, 1121, 1161, 1162, 1151, 1152 take any of a variety of shapes and/or dimensions suitable for enabling coupling with a corner casting by way of a twist lock or Tantlinger lock. For example, the first variety of hole 1111, 1121 may be a stacking hole, the second variety of hole 1151, 1152 may be a stadium hole and the third variety of hole 1161, 1162 may be a shield hole. In a further example, stacking holes are 5.0" long and 2.5" wide and stadium holes are 3.0" long and 2.0575" wide.

FIGS. 8-11 illustrate an example stacking frame 1200 suitable for use in association with disclosed and prior art shipping containers as well as in association with disclosed corner support braces and modular housing systems. Stacking frame 1200 includes an first upper side rail or beam 1212 extending along a length between a front end and a rear end, a first lower side rail or beam 1214 extending along a length between a front end and a rear end, a second upper side rail or beam 1216 extending along a length between a front end and a rear end and a second lower side rail or beam 1218 extending along a length between a front end and a rear end.

A first transverse beam 1231 spans the first upper and second upper side beams at the front end. A second transverse beam 1232 spans the first upper and second upper side beams at the rear end. A third transverse beam (not visible) spans the first lower and second lower side beams at the front end. A fourth transverse beam (not visible) spans the first lower and second lower side beams at the rear end. A fifth transverse beam 1235 may span the first upper and second side beams between the front and rear ends. A sixth transverse beam 1236 may span the first upper and second side beams between the fifth transverse beam and the rear ends.

A first spine beam 1243 spans the first transverse beam and the fifth transverse beam. A second spine beam 1247 spans the fifth transverse beam and the sixth transverse beam.

A first isosceles angle iron 1251 is provided to an exterior surface of the first upper side beam opening towards the rear end of the first upper side beam. A second isosceles angle iron (not visible) is provided to an exterior surface of the first lower side beam opening towards the rear end of the first lower side beam. A third isosceles angle iron 1253 is provided to an exterior surface of the second upper side beam opening towards the rear end of the second upper side beam. A fourth isosceles angle iron 1254 is provided to an exterior surface of the second lower side beam opening towards the rear end of the second lower side beam. A fifth isosceles angle iron 1255 is provided to an exterior surface of the first upper side beam opening towards the front end of the first upper side beam. A sixth isosceles angle iron (not visible) is provided to an exterior surface of the first lower side beam opening towards the front end of the first lower side beam. A seventh isosceles angle iron 1257 is provided to an exterior surface of the second upper side beam opening towards the front end of the second upper side beam. An eighth isosceles angle iron 1258 is provided to an exterior surface of the second lower side beam opening towards the front end of the second lower side beam. Isosceles angle irons 1251-1258 enable secure coupling of corner casting braces such as 1100 to stacking frame 1200.

A first scalene angle iron 1261 is provided to an exterior surface of the first upper side beam opening towards the front end of the first upper side beam. A second scalene angle iron (not visible) is provided to an exterior surface of the first lower side beam opening towards the front end of the first lower side beam. A third scalene angle iron 1263 is provided to an exterior surface of the second upper side beam opening towards the front end of the second upper side beam. A fourth scalene angle iron 1264 is provided to an exterior surface of the second lower side beam opening towards the front end of the second lower side beam. A butt joint angle iron 1273 may be provided to extend from an exterior surface of one or more of the side beams facilitating coupling of a first frame system with an adjacent frame system, for example, at a side beam of the adjacent frame system.

A first stand-off 1221 may space the first upper side beam front end from the first lower side beam front end, a second stand-off (not visible) may space the first upper side beam rear end from the first lower side beam rear end, a third stand-off 1223 may space the second upper side beam front end from the second lower side beam front end and a fourth stand-off 1224 may space the second upper side beam rear end from the second lower side beam rear end.

The frame may further include a fifth stand-off 1225 spacing the first upper side beam from the first lower side beam intermediate the front and rear ends and a sixth stand-off 1226 spacing the second upper side beam from the second lower side beam intermediate the front and rear ends. Still further, the frame may further include a seventh stand-off 1227 spacing the first upper side beam from the first lower side beam intermediate the fifth stand-off and the rear ends and an eighth stand-off 1228 spacing the second upper side beam from the second lower side beam intermediate the sixth stand-off and the rear ends.

The stacking frame may further include a butt joint angle iron 1273 configured to extend from an exterior surface of one or more of the side beams parallel to the transverse beams. A second butt joint angle iron 1277 may be provided so as to extend from an exterior surface of one or more of the side beams.

The frame may further include a frame face plate 1283 mounted to the first and third transverse beams and/or the first and third stand-offs. A frame rear face plate 1287 may be mounted to the second and fourth transverse beams and/or the second and fourth stand-offs and/or near the ends of two or more of the plurality of side beams.

The stacking frame may further include a C-beam 1293 configured to space and span four or more of the side beams near the at least one frame back plate and a casing plate 1297 configured to enclose the C-beam between flanges thereof.

Disclosed side beams, transverse beams, spine beams, isosceles angle irons, scalene angle irons, butt joint angle irons, frame face plates, frame rear plates, C-beams, and casing plates may be formed from any of a variety of solid, durable structural materials suitable for supporting multiple living units including but not limited to steel.

Disclosed side beams, transverse beams, spine beams, isosceles angle irons, scalene angle irons, butt joint angle irons, frame face plates, frame rear plates, C-beams, and casing plates may be provided in any of a variety of dimensions suitable for facilitating stacking of shipping containers for housing.

In an example side beams may be provided approximately in 20' lengths or 40' lengths with 4' by 4' cross-sections, transverse beams may be provided approximately in 8' lengths with 4' by 4' cross-sections, spine beams may be provided approximately in 4' lengths, butt joint angle irons, frame face plates, frame rear plates, C-beams may be provided approximately in 8' lengths with a 13" height, and casing plates may be provided approximately in 8' lengths with a 13" height. Isosceles angle irons may be provided with two flanges or arms having 6" length while scalene angle irons may be provided with one flange or arm having a 3" length and a second flange or arm having a 2" length.

Figure 12:
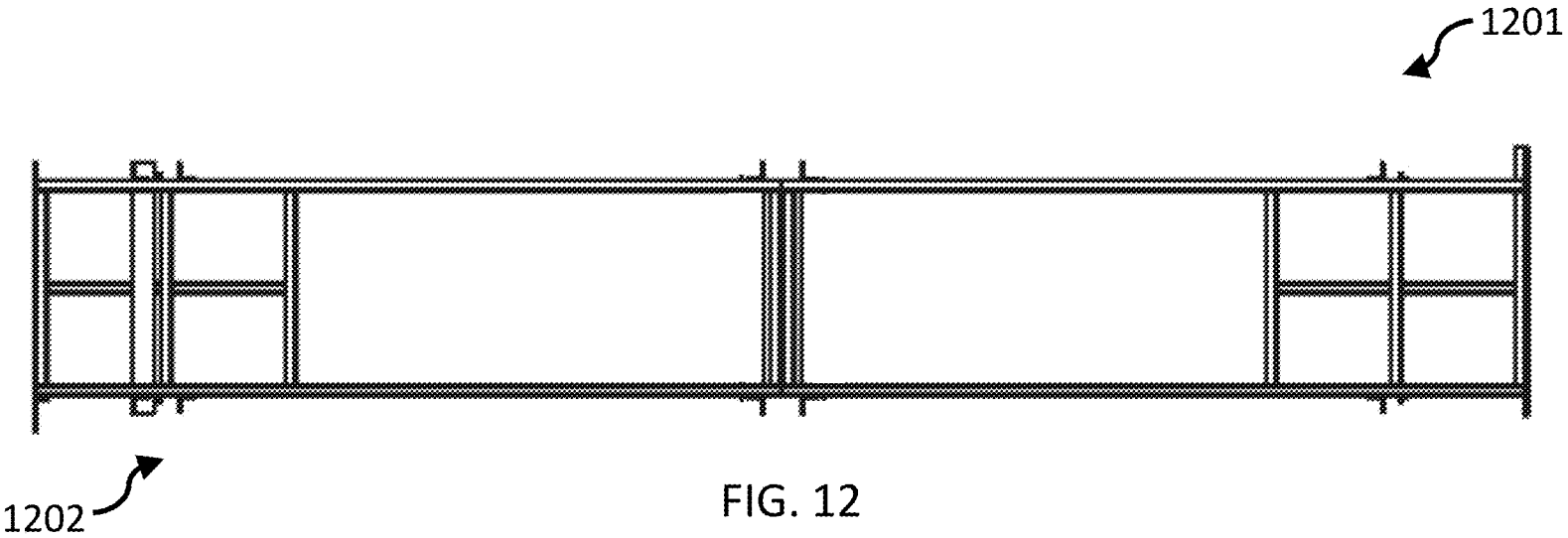
FIG. 12 illustrates a top view of an example stacking frame system suitable for use in association with double-length shipping containers and/or back-to-back shipping containers.

FIG. 12 illustrates a top view of an example stacking frame system suitable for use with double-length shipping containers. The system of FIG. 12 may be similar or equivalent to two of stacking frames 1200 arranged with the back of a first stacking frame 1201 abutted to the back of a second stacking frame 1202. Alternatively, the system of FIG. 12 may resemble a modification of a stacking frame 1200 or may be provided as a single stacking frame having a length approximately twice that of an individual frame 1200.

Figure 13:
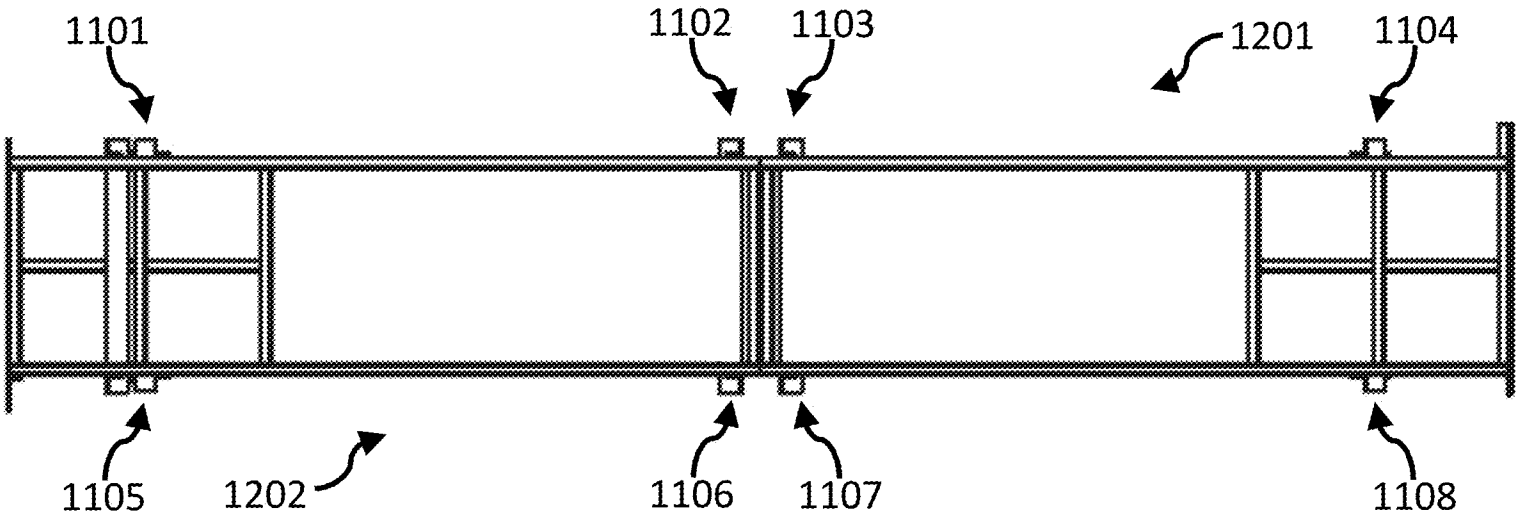
FIG. 13 illustrates another top view of the example stacking frame system of FIG. 12.

FIG. 13 illustrates another top view of the example stacking frame system of FIG. 12 with a number of corner casting support braces 1101, 1102, 1103, 1104, 1105, 1106, 1107, 1108 installed at significant structural points where isosceles angle irons and/or scalene angle irons have been coupled to side beams. In this arrangement, the unitary double-length frame and/or two single-length frames 1201 and 1202 may receive one or more storage units on top such that the associated corner castings align with the corner casting support braces and may be locked thereto with a twist lock or Tantlinger lock.

Figure 14:
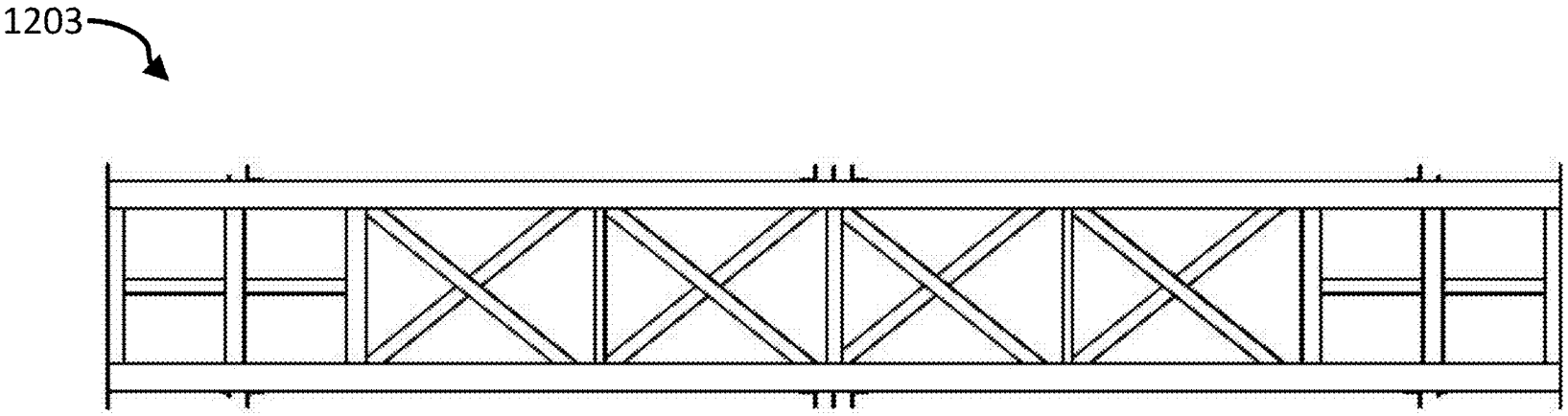
FIG. 14 illustrates a top view of another example stacking frame system suitable for use in association with double-length shipping containers and/or back-to-back shipping containers.
Figure 15:
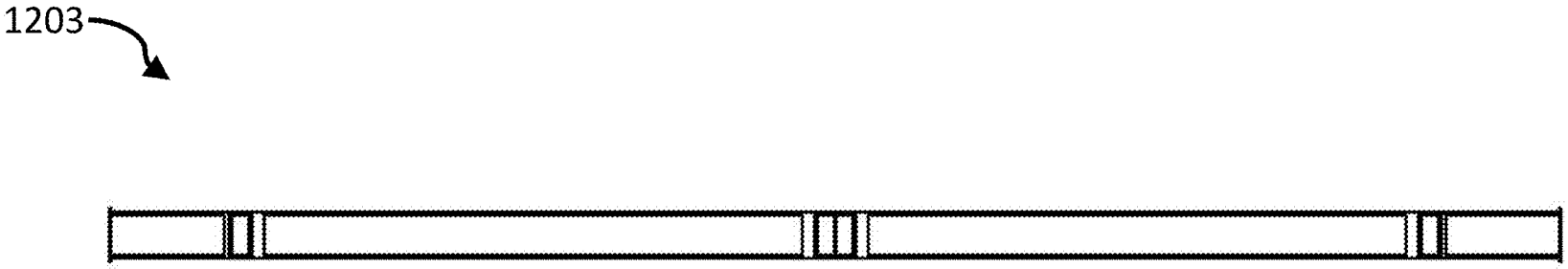
FIG. 15 illustrates another top view of the example stacking frame system of FIG. 14.

FIGS. 14 & 15 illustrate another example stacking frame system 1203 suitable for use in association with double-length shipping containers and/or back-to-back shipping containers and/or double-length residential units. System 1203 may include similar features to those described with reference to or equivalent to two of stacking frames 1200, 1201 and 1203. System 1203 may include additional transverse beams and may further include brace beams arranged at oblique angles between transverse beams and side beams. Pairs of side beams may be replaced with single beams spanning the entire height of the frame or frame system 1203.

Duplicating assemblies such as those described with reference to FIG. 13 may yield modular housing systems 1600. FIG. 14 illustrates an example floor plan for an example modular housing system 1601. A number of shipping containers 1501 are provided in a first row. A number of shipping containers 1502 are provided in a second row separated from the first row by, for example, a foyer or stairwell 1610 (???). A number of shipping containers 1503 are provided in a third row which backs up to the first row. A number of shipping containers are provided in a fourth row 1504 which backs up to the second row and is separated from the third row by the foyer or stairwell 1610. A first balcony 1623 may be provided along entry points for the shipping containers 1501 and 1502 which comprise the first and second rows. A second balcony 1627 may be provided along entry points for the shipping containers 1503 and 1504 which comprise the third and fourth rows.

FIG. 15 illustrates an example floor plan for another example modular housing system 1602. A number of shipping containers 1505, 1506 and 1507 are provided in a first row which includes some residential units which have a first length and a first width, some residential units which have a second length twice the first length and some residential units which have the second length but a variable width. For example, a residential unit of a first variety may be provided by a 20' long shipping container having an 8' width while a residential unit of a second variety may be provided by two 20' shipping containers arranged back to back and a residential unit of a third variety may be provided by two 20' shipping containers arranged back to back with a 20' shipping container arranged side-to-side with one of the first two shipping containers.

A number of shipping containers 1502 and 1503 are provided in a second row which includes some residential units which have a first length and a first width and some residential units which have a second length twice the first length and some residential units which have the second length but a variable width.

The first and second rows may be separated by the foyer or stairwell 1610. A first balcony 1623 may be provided along entry points for the shipping containers 1505 and 1502 which comprise the first and second rows. A second balcony 1627 may be provided along entry points for the shipping containers 1503 and 1504 which comprise the third and fourth rows.

Figure 16:
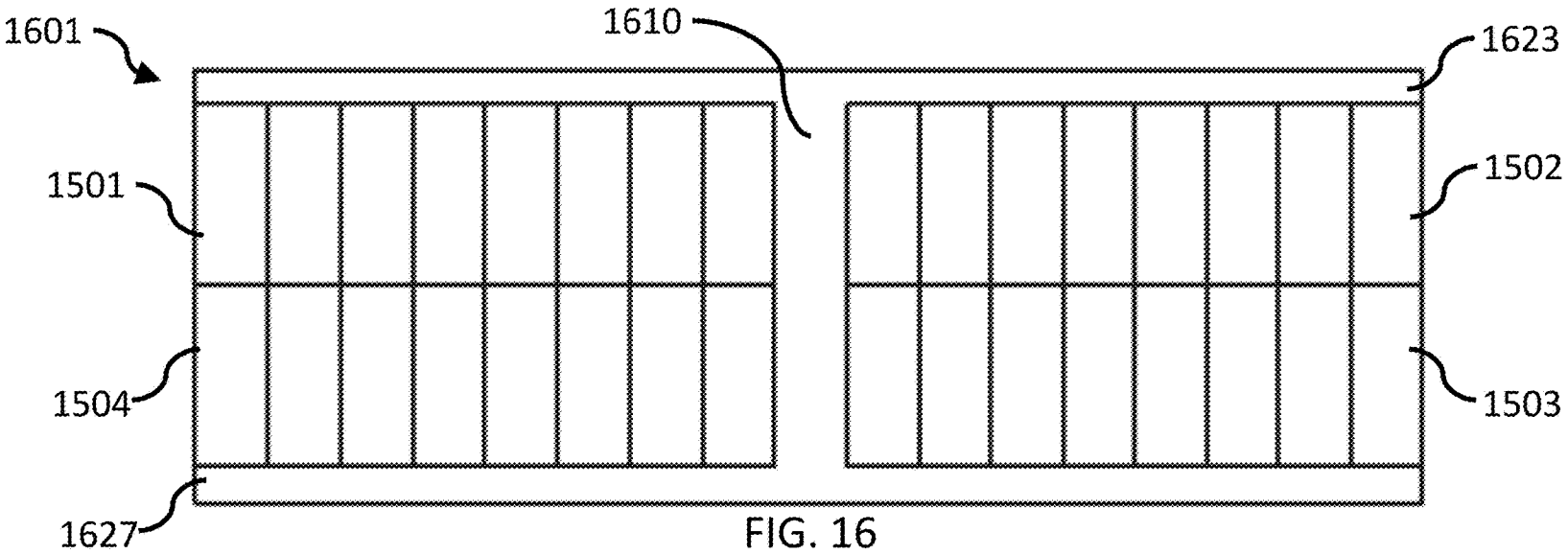
FIG. 16 illustrates an example floor plan for an example modular housing system.
Figure 17:
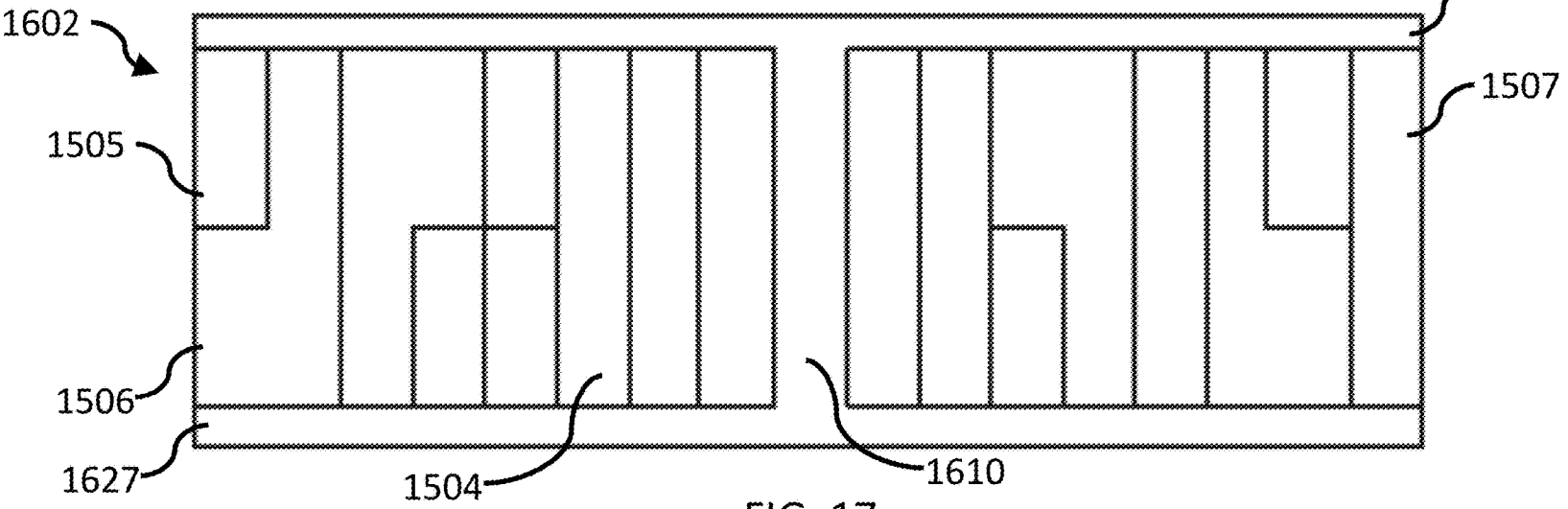
FIG. 17 illustrates another example floor plan for an example modular housing system.
Figure 18:
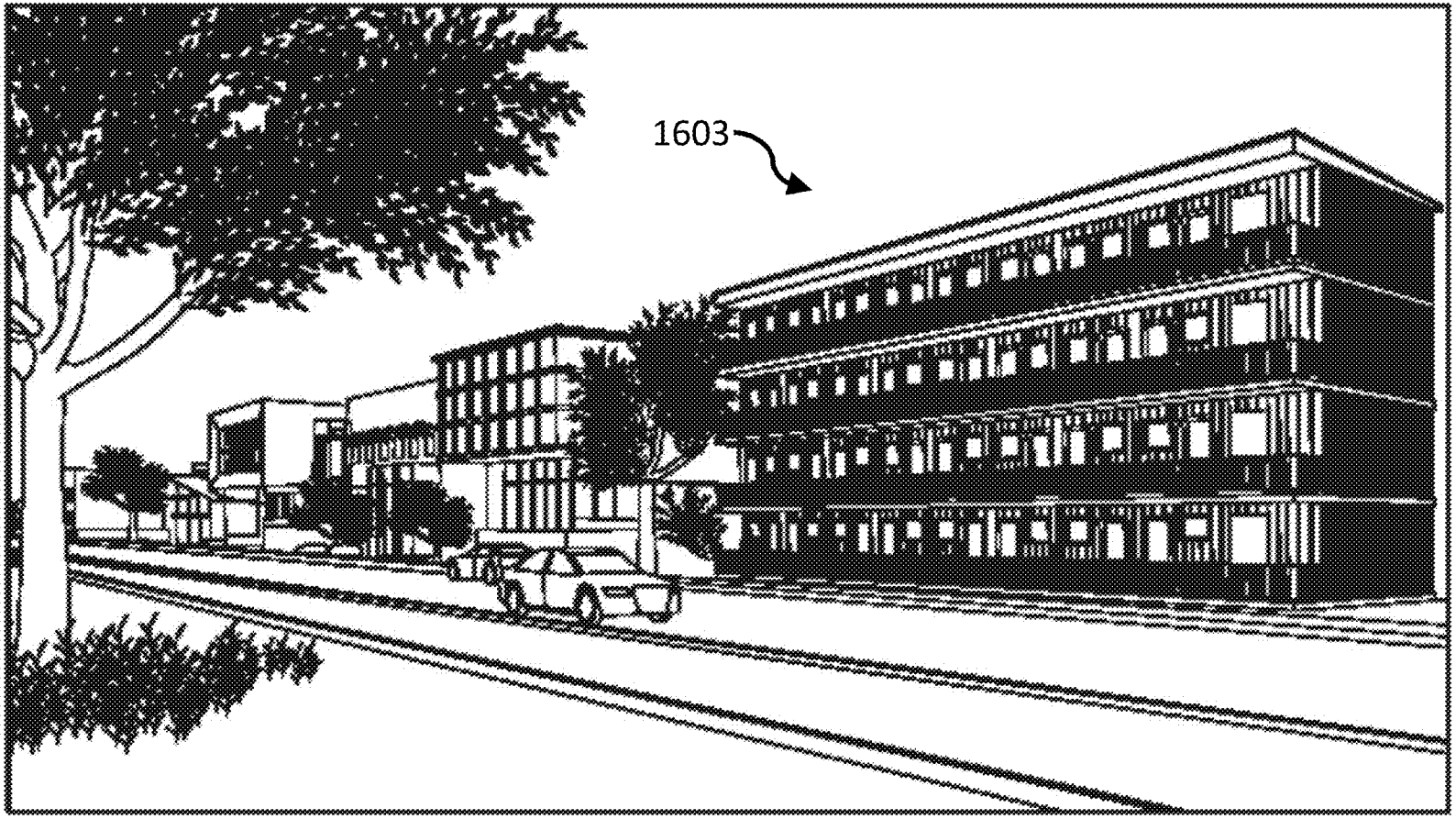
FIG. 18 illustrates a perspective view of an example modular housing system.

FIG. 16 illustrates a perspective view of an example modular housing system 1603. The modular housing system 1603 includes several shipping containers arranged in a row side-to-side on a foundation with first and last members, several corner support braces, front plates and decking. In an example first layer, each shipping container has lower left front, lower right front, upper left front, upper right front, lower left rear, lower right rear, upper left rear and upper right rear corner castings. The lower corner castings each include down-facing holes and the upper corner castings each include up-facing holes.

Decking is provided to a top edge of the first and second side plates and the at least one front plate between the at least one front plate and the first layer of shipping containers such that a walkway or balcony is provided adjacent to the containers.

Open balcony/walkway sections of each structure may be protected by a 48-inch-high continuous safety railing along the open side. The railings may be fabricated at a location other than the assembly construction site and shipped to the appropriate site with other prefabricated components. The structure is manufactured with attached lock-in brackets that secure the railings to the entire assemblage. The railings are manufactured to be set in place and locked into place by insertion into welded brackets. An overhead awning may be provided over the walkways.

A first case or enclosure may be provided for distribution of utilities directly below the walkway or balcony. In an example, the case measures 48 inches wide and is 8 inches deep. The case or enclosure provides a secure and well-protected passageway through which all the electrical wiring, water lines, HVAC apparatus and sewer lines may be run to individual distribution points along their pathway to each of the mini apartments at a given layer.

Housing system 1603 may further include a second layer of shipping containers above the first layer of shipping containers arranged in a second row, side to side such that there are first and last shipping containers in the second row.

In an example, the lower corner castings of the second layer of shipping containers may be coupled to the corner support braces coupled to each of the upper corner castings of the first layer of shipping containers. The lower corner castings of the second layer of shipping containers may be coupled to the corner support braces with a twist lock. The housing may further include a corner support brace coupled to each of the upper corner castings of the second layer of shipping containers.

Modular housing system 1603 may further include a third layer of shipping containers stacked above the second layer of shipping containers in a third row, side to side such that there are first and last shipping containers in the third row. The lower corner castings of the third layer of shipping containers may be coupled to the corner support braces with a twist lock.

Disclosed modular housing systems may be assembled according to any of a variety of methods. According to one example modular housing method, several shipping containers are provided having lower left front, lower right front, upper left front, upper right front, lower left rear, lower right rear, upper left rear and upper right rear corner castings. The lower corner castings each include down-facing holes and the upper corner castings each include up-facing holes.

One corner support brace is coupled to a stacking frame at each of a plurality of locations configured to align with the lower corner castings of the first layer of shipping containers. The stacking frame is provided to a foundation at a building site. A series of stacking frames may be coupled together with, for example, one or more butt joint angle irons.

A twist lock or Tantlinger lock is provided to each of the corner casting support braces and a first layer of the shipping containers is aligned in a row side to side on the stacking frames and twist locks such that there are first and last shipping containers in the row. The twist locks are set to their locked state, thereby locking the first layer of shipping containers to the first stacking frames.

A front face plate may be fixed across each stacking frame. Decking may be provided to a top edge of the first and second upper side beams beyond the corner castings and corner casting support braces such that a case is provided for distribution of utilities.

A rear face plate may similarly be fixed across each stacking frame. Decking may be provided to a top edge of the first and second upper side beams beyond the corner castings and corner casting support braces such that a first case is provided for distribution of utilities.

A second layer of stacking frames may be locked to the upper corner castings of the first layer of shipping containers with the corresponding corner casting support braces and the corresponding number of twist locks.

A twist lock is again provided to each of the corner casting support braces and a second layer of the shipping containers is aligned in a row side to side on the stacking frames and twist locks such that there are first and last shipping containers in the second row. The twist locks are set to their locked state, thereby locking the second layer of shipping containers to the second stacking frames.

A front face plate may be fixed across each stacking frame of the second layer. Decking may be provided to a top edge of the first and second upper side beams beyond the corner castings and corner casting support braces such that a case is provided for distribution of utilities.

A rear face plate may similarly be fixed across each stacking frame. Decking may be provided to a top edge of the first and second upper side beams beyond the corner castings and corner casting support braces such that a first case is provided for distribution of utilities.

A third layer of stacking frames may be locked to the upper corner castings of the second layer of shipping containers with the corresponding corner casting support braces and the corresponding number of twist locks.

A twist lock is again provided to each of the corner casting support braces and a third layer of the shipping containers is aligned in a row side to side on the stacking frames and twist locks such that there are first and last shipping containers in the third row. The twist locks are set to their locked state, thereby locking the third layer of shipping containers to the third stacking frame.

A front face plate may be fixed across each stacking frame of the second layer. Decking may be provided to a top edge of the first and second upper side beams beyond the corner castings and corner casting support braces such that a case is provided for distribution of utilities.

A rear face plate may similarly be fixed across each stacking frame. Decking may be provided to a top edge of the first and second upper side beams beyond the corner castings and corner casting support braces such that a first case is provided for distribution of utilities.

The actions described above are only illustrative and other alternatives can also be provided where one or more actions are added, one or more actions are removed, or one or more actions are provided in a different sequence without departing from the scope of the claims herein.

Embodiments of the disclosure are susceptible to being used for various purposes, including, though not limited to, enabling users to provide housing from shipping containers. Embodiments of the disclosure provide a structural system that enables the user to stack multiple layers of modified shipping containers on top of one another in various configurations that combine to create a single building structure made up of a series habitable self-contained fully insulated living units, or apartments, with full utility services and containing a combination kitchen/living/dining room with washing, cooking and refrigeration accommodations, a private bathroom comprised of a toilet, shower, and vanity sink plus a sleeping area with two twin sized beds to accommodate two adults.

Embodiments may be used to provide low-cost housing accommodations that can be readily erected and put in place on a relatively small footprint of land area in a wide variety of locations and settings. The structural system is fabricated to interlock multiple structures together side by side and/or end to end so that any combination or configuration of apartments may be set up to accommodate varying space allotments and unique site constraints or characteristics to provide instant full-service utilities to one hundred or more individual housing units per utility connection site.

Aligned horizontally and stacked vertically, the apartments may provide durable insulated homes for workforce housing, homeless housing, temporary emergency housing, mini-studio apartment buildings, micro-hotel units, FEMA housing, military site housing, mountain cabins, or any other application where fast and cost-efficient multifamily housing is desired.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim disclosed features are intended to be construed in a non-exclusive manner, namely allowing for items, components or elements not explicitly described also to be present. Reference to the singular is also to be construed to relate to the plural.

What is claimed is:

1. A corner support brace, comprising:

a top plate including first, second, third and fourth edges and a top plate hole located within the edges;

a bottom plate including first, second, third and fourth edges and a bottom plate hole aligned with the top plate hole and located within the edges of the bottom plate;

a first back plate including a first end coupled to the first edge of the top plate and a second end coupled to the first edge of the bottom plate;

a second back plate including a first end coupled to the second edge of the top plate and a second end coupled to the second edge of the bottom plate;

a first face plate including at least one first face plate hole located therein, a first end coupled to the third edge of the top plate and a second end coupled to the third edge of the bottom plate;

a second face plate including at least one second face plate hole located therein matching the at least one first face plate hole, a first end coupled to the fourth edge of the top plate and a second end coupled to the fourth edge of the bottom plate; and a mid-plate coupled between the first and second back plates and the first and second face plates and spaced apart from the top and bottom plates, wherein at least one of (i) the at least one first face plate hole comprises two first face plate holes or (ii) the at least one second face plate hole comprises two second face plate holes, and wherein the corner support brace is a unitary structure of one-piece construction.

2. A corner support brace, consisting essentially of:

a top plate including first, second, third and fourth edges and a top plate hole located within the edges;

a bottom plate including first, second, third and fourth edges and a bottom plate hole aligned with the top plate hole and located within the edges of the bottom plate;

a first back plate including a first end coupled to the first edge of the top plate and a second end coupled to the first edge of the bottom plate;

a second back plate including a first end coupled to the second edge of the top plate and a second end coupled to the second edge of the bottom plate;

a first face plate including at least one first face plate hole located therein, a first end coupled to the third edge of the top plate and a second end coupled to the third edge of the bottom plate;

a second face plate including at least one second face plate hole located therein matching the at least one first face plate hole, a first end coupled to the fourth edge of the top plate and a second end coupled to the fourth edge of the bottom plate; and a mid-plate coupled between the first and second back plates and the first and second face plates and spaced apart from the top and bottom plates.

3. The corner support brace as set forth in claim 2, wherein the top and bottom plate hole is a stacking hole.

4. The corner support brace as set forth in claim 2, wherein at least one of the first and second face plate holes is a stadium hole.

5. The corner support brace as set forth in claim 2, wherein the at least one first face plate hole comprises two first face plate holes.

6. The corner support brace as set forth in claim 2, wherein the at least one second face plate hole comprises two second face plate holes.

7. The corner support brace as set forth in claim 6, wherein at least one of the face plate holes is a shield hole.

8. A stacking frame, comprising:

a first upper side beam extending along a length between a front end and a rear end thereof;

a first lower side beam extending along a length between a front end and a rear end thereof;

a second upper side beam extending along a length between a front end and a rear end thereof;

a second lower side beam extending along a length between a front end and a rear end thereof;

a first transverse beam spanning the first upper and second upper side beams at the front end thereof;

a second transverse beam spanning the first upper and second upper side beams at the rear end thereof;

a third transverse beam spanning the first lower and second lower side beams at the front end thereof;

a fourth transverse beam spanning the first lower and second lower side beams at the rear end thereof;

a fifth transverse beam spanning the first upper and second side beams between the front and rear ends thereof;

a sixth transverse beam spanning the first upper and second side beams between the fifth transverse beam and the rear ends thereof;

a first spine beam spanning the first transverse beam and the fifth transverse beam;

a second spine beam spanning the fifth transverse beam and the sixth transverse beam;

a first isosceles angle iron provided to an exterior surface of the first upper side beam opening towards the rear end of the first upper side beam;

a second isosceles angle iron provided to an exterior surface of the first lower side beam opening towards the rear end of the first lower side beam;

a third isosceles angle iron provided to an exterior surface of the second upper side beam opening towards the rear end of the second upper side beam;

a fourth isosceles angle iron provided to an exterior surface of the second lower side beam opening towards the rear end of the second lower side beam;

a fifth isosceles angle iron provided to an exterior surface of the first upper side beam opening towards the front end of the first upper side beam;

a sixth isosceles angle iron provided to an exterior surface of the first lower side beam opening towards the front end of the first lower side beam;

a seventh isosceles angle iron provided to an exterior surface of the second upper side beam opening towards the front end of the second upper side beam;

an eighth isosceles angle iron provided to an exterior surface of the second lower side beam opening towards the front end of the second lower side beam;

a first scalene angle iron provided to an exterior surface of the first upper side beam opening towards the front end of the first upper side beam;

a second scalene angle iron provided to an exterior surface of the first lower side beam opening towards the front end of the first lower side beam;

a third scalene angle iron provided to an exterior surface of the second upper side beam opening towards the front end of the second upper side beam;

a fourth scalene angle iron provided to an exterior surface of the second lower side beam opening towards the front end of the second lower side beam;

a butt joint angle iron configured to extend from an exterior surface of one or more of the side beams; and a plurality of the corner support braces as set forth in claim 2, each corner support brace coupled to one of the side beams abutting one of the isosceles angle irons.

9. The frame as set forth in claim 8, further comprising:

a first stand-off spacing the first upper side beam front end from the first lower side beam front end;

a second stand-off spacing the first upper side beam rear end from the first lower side beam rear end;

a third stand-off spacing the second upper side beam front end from the second lower side beam front end; and a fourth stand-off spacing the second upper side beam rear end from the second lower side beam rear end.

10. The frame as set forth in claim 9, further comprising:

at least one frame face plate mounted to at least one of (i) the first and third transverse beams or (ii) the first and third stand-offs.

11. The frame as set forth in claim 9, further comprising:

a fifth stand-off spacing the first upper side beam from the first lower side beam intermediate the front and rear ends thereof; and a sixth stand-off spacing the second upper side beam from the second lower side beam intermediate the front and rear ends thereof.

12. The frame as set forth in claim 11, further comprising:

a seventh stand-off spacing the first upper side beam from the first lower side beam intermediate the fifth stand-off and the rear ends thereof; and an eighth stand-off spacing the second upper side beam from the second lower side beam intermediate the sixth stand-off and the rear ends thereof.

13. A modular housing system, comprising:

a plurality of side beams;

a plurality of transverse beams spanning two or more of the side beams;

at least one spine beam spanning two or more of the transverse beams;

a plurality of isosceles angle irons provided to exterior surfaces of the plurality of side beams;

a plurality of scalene angle irons provided to the exterior surfaces of the plurality of side beams opening away from the isosceles angle irons; and a plurality of the corner support braces as set forth in claim 2, each corner support brace coupled to one of the side beams abutting one of the isosceles angle irons.

14. The modular housing system as set forth in claim 13, further comprising a butt joint angle iron configured to extend from a respective said exterior surface of one or more of the side beams.

15. The modular housing system as set forth in claim 13, further comprising at least one frame face plate configured for mounting to two or more of the transverse beams.

16. The modular housing system as set forth in claim 13, further comprising:

a C-shaped beam configured to space and span four or more of the side beams proximate at least one frame back plate; and a casing plate configured to enclose the C-shaped beam between flanges thereof.

17. The modular housing system as set forth in claim 13, wherein the top and bottom plate hole is a stacking hole.

18. The modular housing system as set forth in claim 13, wherein at least one of the first and second face plate holes is a stadium hole.

19. The modular housing system as set forth in claim 13, wherein the at least one first face plate hole comprises two first face plate holes.

20. The modular housing system as set forth in claim 13, wherein the at least one second face plate hole comprises two second face plate holes.

21. The modular housing system as set forth in claim 20, wherein at least one of the face plate holes is a shield hole.

* * * * *